US010453289B1

(12) United States Patent
Baunsit et al.

(10) Patent No.: US 10,453,289 B1
(45) Date of Patent: Oct. 22, 2019

(54) COIN CHUTE FOR A SELF-SERVICE TERMINAL

(71) Applicants: Limhar Antona Baunsit, Cebu (PH); Steven Hassenzahl, Snellville, GA (US); Danis Delos Reyes Paninsoro, Mandaue (PH); Emmanuel Sendico Ruales, Bacolod (PH); Osamu Takagi, Kanagawa (JP)

(72) Inventors: Limhar Antona Baunsit, Cebu (PH); Steven Hassenzahl, Snellville, GA (US); Danis Delos Reyes Paninsoro, Mandaue (PH); Emmanuel Sendico Ruales, Bacolod (PH); Osamu Takagi, Kanagawa (JP)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 15/964,452

(22) Filed: Apr. 27, 2018

(51) Int. Cl.

| | |
|---|---|
| ***G07F 1/04*** | (2006.01) |
| ***G07D 1/02*** | (2006.01) |
| ***G07D 9/00*** | (2006.01) |
| ***G07F 1/02*** | (2006.01) |

(52) U.S. Cl.
CPC ..... *G07D 1/02* (2013.01); *G07D 9/00* (2013.01); *G07F 1/02* (2013.01); *G07F 1/04* (2013.01); *G07F 1/045* (2013.01); *G07D 2201/00* (2013.01)

(58) Field of Classification Search
CPC .... G07D 1/02; G07D 9/00; G07F 1/02; G07F 1/04; G07F 1/045
See application file for complete search history.

(56) References Cited

U.S. PATENT DOCUMENTS

| | | | | |
|---|---|---|---|---|
| 5,226,521 A * | 7/1993 | Oden | G07F 1/00 | 150/154 |
| 5,524,143 A * | 6/1996 | Turk | H04M 17/026 | 194/202 |
| 6,269,929 B1 * | 8/2001 | McClellan | G07F 1/02 | 194/344 |

* cited by examiner

*Primary Examiner* — Mark J Beauchaine
(74) *Attorney, Agent, or Firm* — Schwegman, Lundberg & Woessner

(57) ABSTRACT

Disclosed is a coin chute protector for a self-service terminal. The coin chute protector may comprise a body having a first surface and a second surface. The second surface may define a channel arranged to direct a liquid toward a first edge of the second surface. The coin chute protector may be sized to fit within an indentation defined by a coin chute of the self-service terminal.

20 Claims, 4 Drawing Sheets

COIN CHUTE FOR A SELF-SERVICE TERMINAL

BACKGROUND

Self-service terminals (SSTs) may include a coin accepter. The coin accepter may be oriented such that a coin chute is exposed to liquids. The liquids may include rain and snow as well as beverages or other liquids that a user may spill on the SST. The coin chute may include a large opening that will allow multiple coins to be deposited at once, sometimes referred to as bulk coin entry. In other embodiments the coin chute may have an opening that allows for a single coin to be deposited at a time.

The opening, whether large or small, may allow liquids to enter the SST. The liquids are bad for the SST because they may cause rust or other corrosion within the SST. In addition, the liquids may cause electrical shorts or otherwise damage electrical components of the SST.

SUMMARY

Disclosed is a coin chute protector for a self-service terminal. The coin chute protector may comprise a body having a first surface and a second surface. The second surface may define a channel arranged to direct a liquid toward a first edge of the second surface. The coin chute protector may be sized to fit within an indentation defined by a coin chute of the self-service terminal.

BRIEF DESCRIPTION OF THE FIGURES

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the invention any manner.

DETAILED DESCRIPTION

Figure 1:
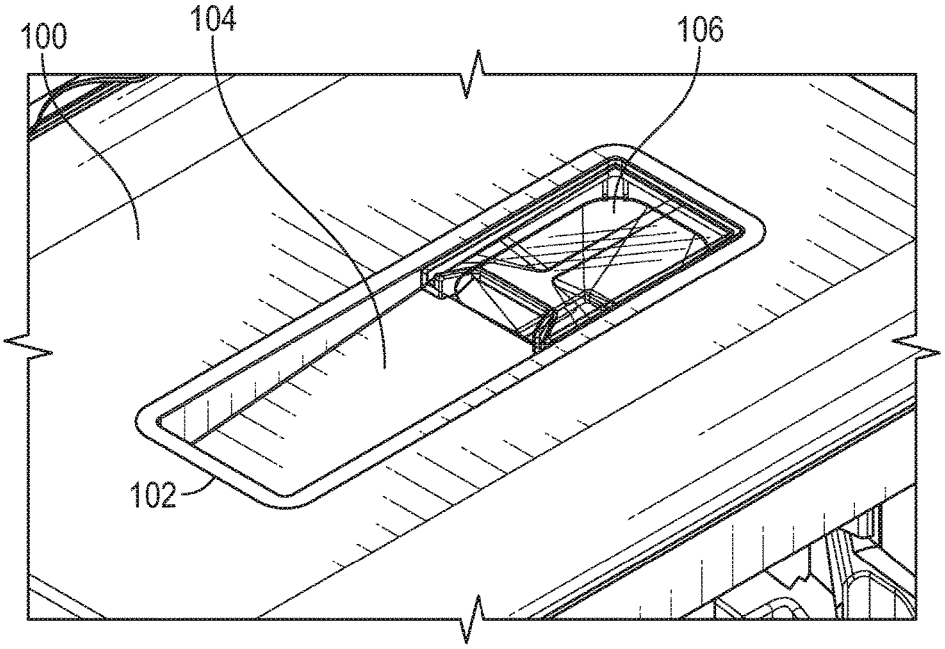
FIG. 1 shows an example housing of a self-service terminal consistent with this disclosure.

The following detailed description refers to the accompanying drawings, Wherever possible, the same reference numbers are used in the drawings and the following description to refer to the same or similar elements. While embodiments and examples are described, modifications, adaptations, and other implementations are possible. For example, substitutions, additions, or modifications may be made to the elements and stages illustrated in the drawings, and the systems and methods described herein may be modified by substituting, reordering, or adding stages to the disclosed methods or elements to the discloses systems. Accordingly, the following detailed description does not limit this disclosure. Instead, the proper scope of any invention disclosed herein is defined by the appended claims.

Self-service terminals (SSTs) may include a coin accepter. The coin accepter may be oriented such that a coin chute is exposed to liquids. The liquids may include rain and snow as well as beverages or other liquids that a user may spill on the SST. The coin chute may include a large opening that will allow multiple coins to be deposited at once, sometimes referred to as bulk coin entry. In other embodiments the coin chute may have an opening that allows for a single coin to be deposited at a time.

The opening, whether large or small, may allow liquids to enter the SST. The liquids are bad for the SST because they may cause rust or other corrosion within the SST, In addition, the liquids may cause electrical shorts or otherwise damage electrical components of the SST.

As disclosed herein, a coin chute protector may be used to hinder liquids from entering the coin chute via opening. The coin chute protector may include a body that totally or partially covers the opening while still allowing a user to place coins into the SST.

FIG. 1 shows an example housing 100 of a self-service terminal consistent with this disclosure. As shown in FIG. 1, housing 100 may define an opening 102. A coin slide 104 may be sized to fit within opening 102. A coin chute protector 106 may be attached to coin slide 104. For example, as shown in FIG. 1, coin chute protector 106 may be sized such that it may be press fit into coin slide 104. In addition, an epoxy or ultrasonic welding may be used to secure coin chute protector 106 to coin slide 104.

Figure 2:
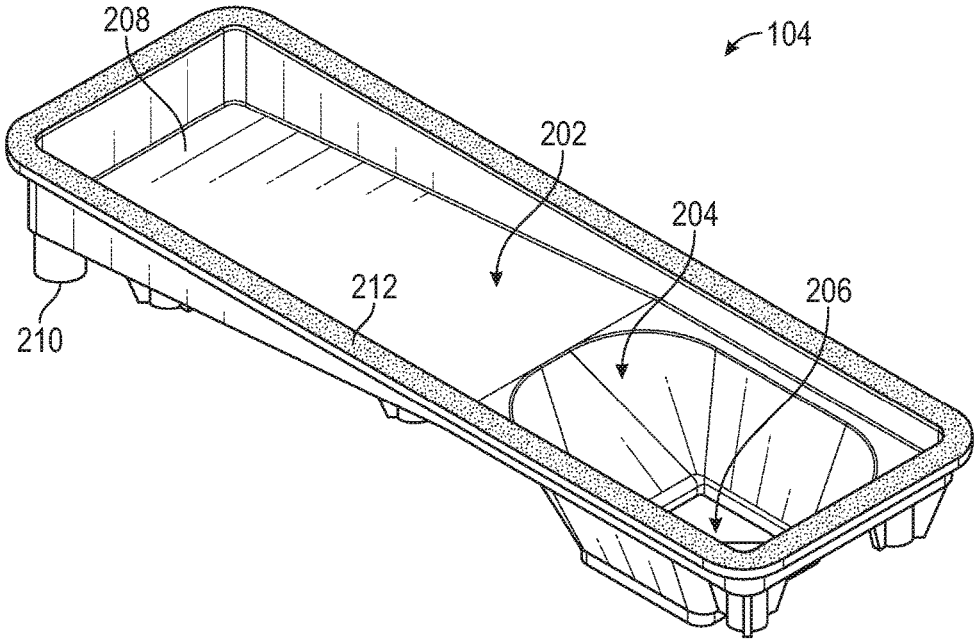
FIG. 2 shows an example coin chute consistent with this disclosure.

FIG. 2 shows coin slide 104. As shown in FIG. 2, coin slide 104 may include a first surface 202 and a second surface 204. Second surface 204 may define an opening 206. Opening 206 may be sized to allow one or more coins to pass through coin slide 104 and opening 102 into the SST.

First surface 202 may be located adjacent to second surface 204. First surface 202 may also be angled relative to second surface or opening 206 such that any liquid that may come into contact with first surface 202 drains away from opening 206 as disclosed herein. For example, liquids that contact first surface 202 may flow towards a water trap 208. Water trap 208 may collect liquids and allow them to drain via a drain 210. While FIG. 2 shows a single drain, coin slide 104 may include one or more drains.

Coin slide 104 may also include a textured portion 212. Textured portion 212 may assist in preventing liquids and other debris from sliding from housing 100 into coin slide 104. In addition, textured portions 212 may assist those with a sight impairment in locating coin slide 104.

Figure 3:
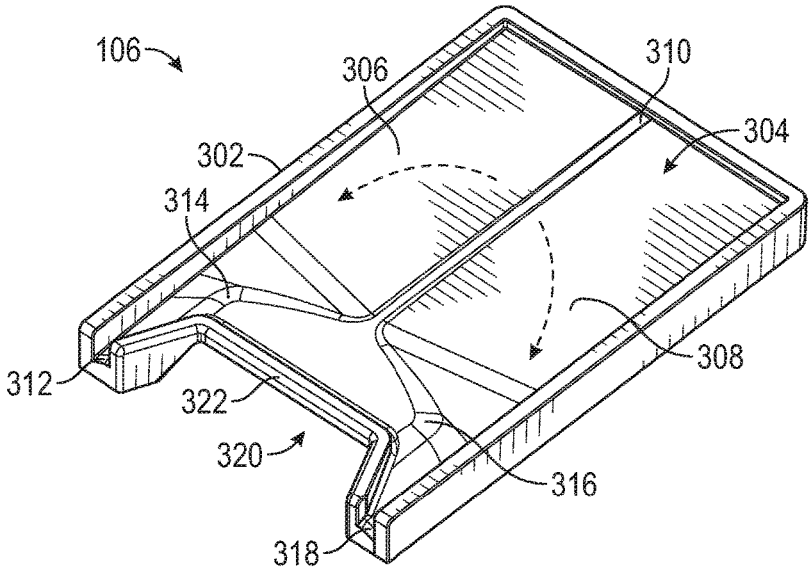
FIG. 3 shows an example coin chute protector consistent with this disclosure.

FIG. 3 shows coin chute protector 106. Coin chute protector 106 may include a body 302. Body 302 may include a first surface 304 that may be divided into a first portion 306 and a second portion 308, First portion 306 and second portion 308 may be angled relative to one another such that liquid that contacts first surface 304 may be diverted to a channel 310. Channel 310 may be sloped such that liquids flow toward an edge of body 302. For example, the liquids may flow towards a first exit 312. Channel 310 may be bifurcated with a first portion 314 directing liquids toward first exit 312 and a second portion 316 directing liquids toward a second exit 318. The shape of the first and second exits 312, 318 may vary in different embodiments. For example, the ends of the first and second exits 312, 318 are illustrated as terminating as perpendicularly oriented to the direction of water flow. In other embodiments, the ends of the first and second exits 312, 318 may instead be tapered or another shape.

Body 302 also may define a recess 320. As disclosed herein, recess 320 may allow coins to be inserted into opening 206 of coin slide 104. Body 302 may further define a lip 322. Lip 322 may hinder liquid flowing in channel 310 from spilling over into recess 320.

As disclosed herein, coin slide 104 and coin chute protector 106 may be manufactured from metals, polymers, ceramics, or any combination thereof and any known manufacturing techniques. For example, coin slide 104 and coin chute protector 106 may be manufactured from a polymer and injection molded. In another example, coin slide 104 may be machined from a metallic billet and coin chute protector 106 may be injection molded from a polymer.

Figure 4A:
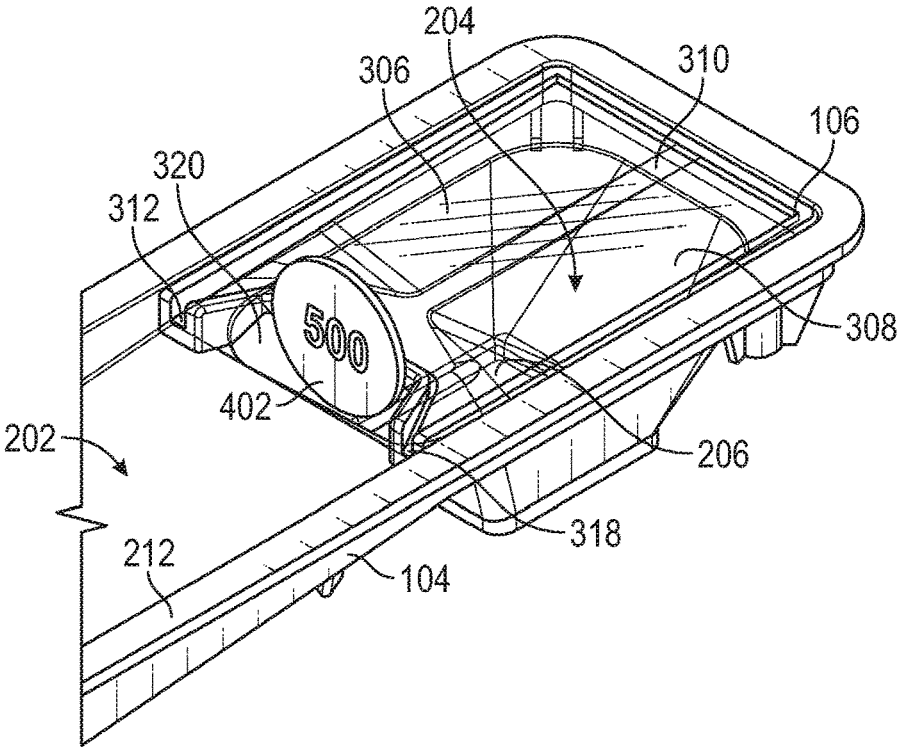
FIGS. 4A and 4B show an example coin insertion consistent with this disclosure.
Figure 4B:
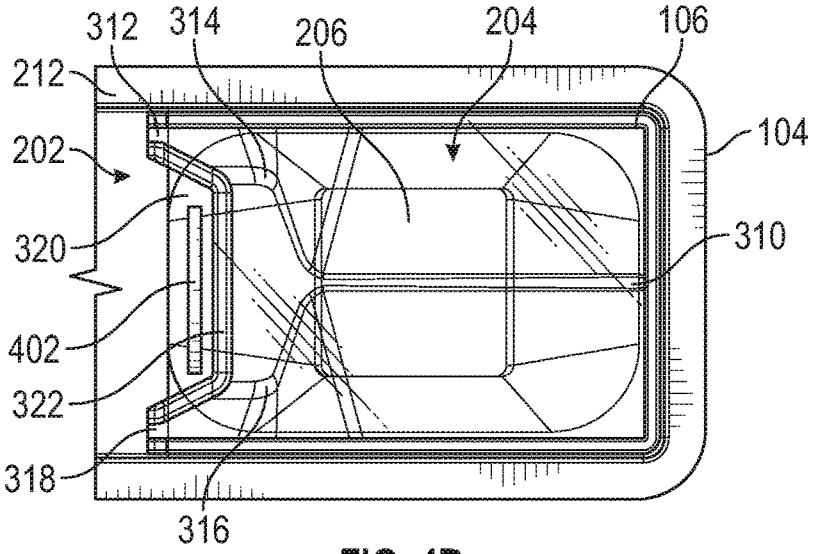

FIGS. 4A and 4B show an example coin insertion consistent with embodiments disclosed herein. As shown in FIGS. 4A and 4B, a coin 402 may be inserted into recess 320 in a vertical orientation. Recess 320 may extend over a portion of second surface 204 yet not extend so far as to expose opening 206. As a coin 402 is inserted into recess 320, coin 402 may contact second surface 204 and rotate slightly so as to slide down second surface 204 and through opening 206.

To assist with rotation of coin 402, coin chute protector 106 may be elevated above surfaces 202 and 204. For instance, first surface 202 and second surface 204 may be recessed below textured portion 212 thus forming a recess or indentation in which coin chute protector 106 may be press fit such that edges of first surface 304 may be flush with textured portion 212. Coin chute protector 106 may also be slightly raised or recessed relative to textured portion 212.

Figure 5A:
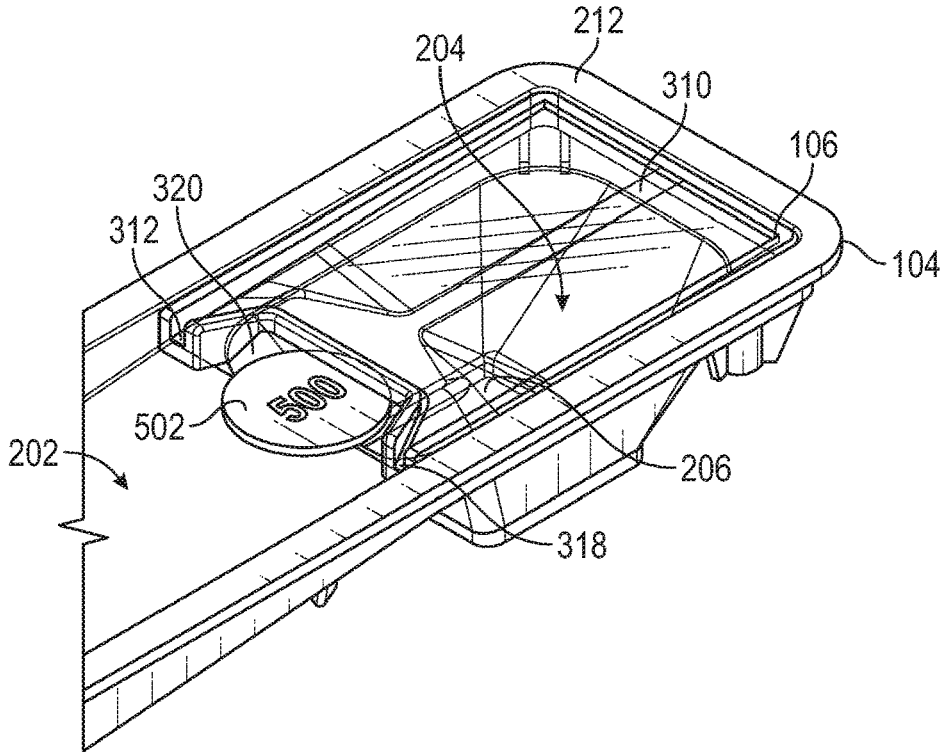
FIGS. 5A and 5B show an example coin insertion consistent with this disclosure.
Figure 5B:
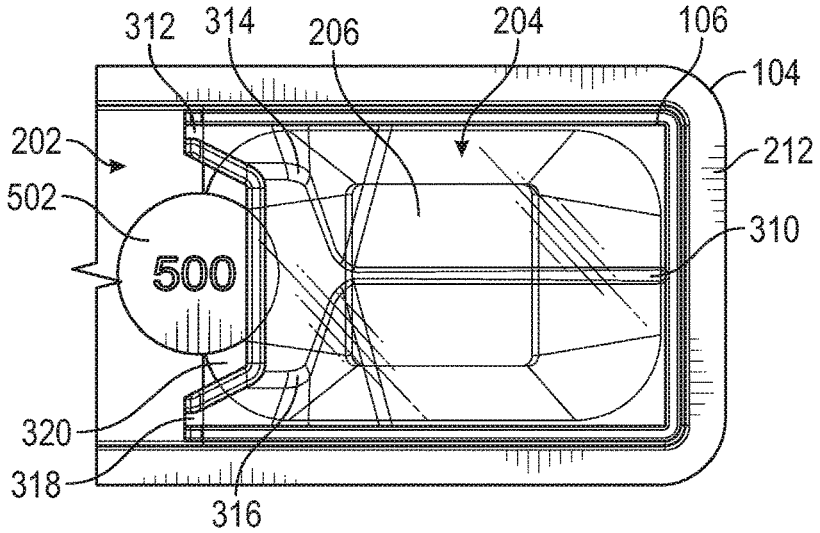

FIGS. 5A and 5B show an example coin insertion consistent with embodiments disclosed herein. As shown in FIGS. 5A and 5B, a coin 502 may be inserted into recess 320 in a horizontal orientation. To assist with insertion of coin 502, coin chute protector 106 may be elevated above surfaces 202 and 204 as described above with respect to FIGS. 4A and 4B. In addition, recess 320 may extend over a portion of second surface 204 as described above with respect to FIGS. 4A and 4B. Thus, during insertion, coin 502 may slide along first surface 202. Once the user releases coin 502, it may rotation about the intersection of first surface 202 and second surface 204 such that a portion of coin 502 rotates into recess 320. Coin 502 may then slide along second surface 204 and through opening 206.

EXAMPLES

Example 1 is a coin chute protector for a self-service terminal, the coin chute protector comprising: a body having a first surface and a second surface, the second surface defining a channel arranged to direct a liquid toward a first edge of the second surface, wherein the coin chute protector is sized to fit within an indentation defined by a coin chute of the self-service terminal.

In Example 2, the subject matter of Example 1 optionally includes wherein the body further defines a recess located proximate the first edge of the second surface, the recess sized to allow a coin to pass into the coin chute of the self-service terminal.

In Example 3, the subject matter of any one or more of Examples 1-2 optionally include wherein the channel includes a bifurcation with a first portion and a second portion, the first portion of the channel arranged to direct a first portion of the liquid toward the first edge of the second surface and the second portion of the channel arrange to direct a second portion of the liquid toward a second edge of the second surface.

In Example 4, the subject matter of any one or more of Examples 1-3 optionally include wherein the body further defines an exit in fluid communication with the channel.

In Example 5, the subject matter of any one or more of Examples 1-4 optionally include wherein the body is formed of a transparent polymer.

In Example 6, the subject matter of any one or more of Examples 1-5 optionally include wherein the second surface includes a texture.

Example 7 is a coin chute for a self-service terminal, the coin chute comprising: a coin slide having a first surface and a second surface adjacent to the first surface, the first surface defining a first opening sized to allow a coin to pass from a first side of the coin slide to a second side of the coin slide, the second surface arranged at an angle relative to the first opening; and a coin chute protector having a third surface and a fourth surface, the fourth surface defining a channel arranged to direct a liquid toward a first edge of the fourth surface, the coin chute protector sized to fit within a recess defined by the coin side and located proximate the first opening.

In Example 8, the subject matter of Example 7 optionally includes wherein the coin chute protector further defines a recess located proximate the first edge of the fourth surface, the recess sized to allow the coin to pass into the first opening.

In Example 9, the subject matter of any one or more of Examples 7-8 optionally include wherein the channel includes a bifurcation with a first portion and a second portion, the first portion of the channel arranged to direct a first portion of the liquid toward the first edge of the fourth surface and the second portion of the channel arrange to direct a second portion of the liquid toward a second edge of the fourth surface.

In Example 10, the subject matter of any one or more of Examples 7-9 optionally include wherein the coin slide defines a drain located at a lower end of the second surface.

In Example 11, the subject matter of any one or more of Examples 7-10 optionally include wherein the coin chute protector is formed of a transparent polymer.

In Example 12, the subject matter of any one or more of Examples 7-11 optionally include wherein the fourth surface includes a texture.

In Example 13, the subject matter of any one or more of Examples 7-12 optionally include wherein an exit of the channel is located above the second surface.

Example 14 is a self-service terminal comprising: a housing defining a first opening and containing coin accepter; a coin slide sized to fit into the first opening and having a first surface and a second surface adjacent to the first surface, the first surface defining a second opening sized to allow a coin to pass into the coin accepter, the second surface arranged at an angle relative to the second opening; and a coin chute protector having a third surface and a fourth surface, the fourth surface defining a channel arranged to direct a liquid toward a first edge of the fourth surface, the coin chute protector sized to fit within a recess defined by the coin side and located proximate the second opening.

In Example 15, the subject matter of Example 14 optionally includes wherein the coin chute protector further defines a recess located proximate the first edge of the fourth surface, the recess sized to allow the coin to pass into the second opening.

In Example 16, the subject matter of any one or more of Examples 14-15 optionally include wherein the channel includes a bifurcation with a first portion and a second portion, the first portion of the channel arranged to direct a first portion of the liquid toward the first edge of the fourth surface and the second portion of the channel arrange to direct a second portion of the liquid toward a second edge of the fourth surface.

In Example 17, the subject matter of any one or more of Examples 14-16 optionally include wherein the coin slide defines a drain located at a lower end of the second surface.

In Example 18, the subject matter of any one or more of Examples 14-17 optionally include wherein the coin chute protector is formed of a transparent polymer.

In Example 19, the subject matter of any one or more of Examples 14-18 optionally include wherein the fourth surface includes a texture.

In Example 20, the subject matter of any one or more of Examples 14-19 optionally include wherein an exit of the channel is located above the second surface.

It will be readily understood to those skilled in the art that various other changes in the details, material, and arrangements of the parts and method stages which have been described and illustrated in order to explain the nature of the inventive subject matter may be made without departing from the principles and scope of the inventive subject matter as expressed in the subjoined claims.

The invention claimed is:

1. A coin chute protector for a self-service terminal, the coin chute protector comprising:

a body having a first surface and a second surface, the second surface defining a channel arranged to direct a liquid toward a first edge of the second surface, wherein the coin chute protector is sized to fit within an indentation defined by a coin chute of the self-service terminal.

2. The coin chute protector of claim 1, wherein the body further defines a recess located proximate the first edge of the second surface, the recess sized to allow a coin to pass into the coin chute of the self-service terminal.

3. The coin chute protector of claim 1, wherein the channel includes a bifurcation with a first portion and a second portion, the first portion of the channel arranged to direct a first portion of the liquid toward the first edge of the second surface and the second portion of the channel arrange to direct a second portion of the liquid toward a second edge of the second surface.

4. The coin chute protector of claim 1, wherein the body further defines an exit in fluid communication with the channel.

5. The coin chute protector of claim 1, wherein the body is formed of a transparent polymer.

6. The coin chute protector of claim 1, wherein the second surface includes a texture.

7. A coin chute for a self-service terminal, the coin chute comprising:

a coin slide having a first surface and a second surface adjacent to the first surface, the first surface defining a first opening sized to allow a coin to pass from a first side of the coin slide to a second side of the coin slide, the second surface arranged at an angle relative to the first opening; and a coin chute protector having a third surface and a fourth surface, the fourth surface defining a channel arranged to direct a liquid toward a first edge of the fourth surface, the coin chute protector sized to fit within a recess defined by the coin side and located proximate the first opening.

8. The coin chute of claim 7, wherein the coin chute protector further defines a recess located proximate the first edge of the fourth surface, the recess sized to allow the coin to pass into the first opening.

9. The coin chute of claim 7, wherein the channel includes a bifurcation with a first portion and a second portion, the first portion of the channel arranged to direct a first portion of the liquid toward the first edge of the fourth surface and the second portion of the channel arrange to direct a second portion of the liquid toward a second edge of the fourth surface.

10. The coin chute of claim 7, wherein the coin slide defines a drain located at a lower end of the second surface.

11. The coin chute of claim 7, wherein the coin chute protector is formed of a transparent polymer.

12. The coin chute of claim 7, wherein the fourth surface includes a texture.

13. The coin chute of claim 7, wherein an exit of the channel is located above the second surface.

14. A self-service terminal comprising:

a housing defining a first opening and containing coin accepter;

a coin slide sized to fit into the first opening and having a first surface and a second surface adjacent to the first surface, the first surface defining a second opening sized to allow a coin to pass into the coin accepter, the second surface arranged at an angle relative to the second opening; and a coin chute protector having a third surface and a fourth surface, the fourth surface defining a channel arranged to direct a liquid toward a first edge of the fourth surface; the coin chute protector sized to fit within a recess defined by the coin side and located proximate the second opening.

15. The self-service terminal of claim 14, wherein the coin chute protector further defines a recess located proximate the first edge of the fourth surface; the recess sized to allow the coin to pass into the second opening.

16. The self-service terminal of claim 14, wherein the channel includes a bifurcation with a first portion and a second portion, the first portion of the channel arranged to direct a first portion of the liquid toward the first edge of the fourth surface and the second portion of the channel arrange to direct a second portion of the liquid toward a second edge of the fourth surface.

17. The self-service terminal of claim 14, wherein the coin slide defines a drain located at a lower end of the second surface.

18. The self-service terminal of claim 14, wherein the coin chute protector is formed of a transparent polymer.

19. The self-service terminal of claim 14, wherein the fourth surface includes a texture.

20. The self-service terminal of claim 14, wherein an exit of the channel is located above the second surface.

* * * * *